US005527014A

United States Patent [19]

Bracewell

[11] Patent Number: 5,527,014

[45] Date of Patent: Jun. 18, 1996

[54] DECK BOARD PUSHING AND CLAMPING DEVICE

[76] Inventor: Michael Bracewell, 13411 Starfish Dr., Hudson, Fla. 34667

[21] Appl. No.: 337,032

[22] Filed: Nov. 10, 1994

[51] Int. Cl.[6] ..... B66F 3/00

[52] U.S. Cl. ..... 254/15

[58] Field of Search ..... 254/11, 15–17, 254/113–120, 131; 29/238

[56] References Cited

U.S. PATENT DOCUMENTS

| | | | |
|---|---|---|---|
| 396,104 | 1/1889 | Morrill | 254/15 |
| 721,681 | 3/1903 | Early | 254/15 |
| 1,283,209 | 10/1918 | Kimble | 254/15 |
| 2,351,691 | 6/1944 | Mansir | 254/15 |
| 2,780,437 | 2/1957 | Ham | 254/16 |
| 3,779,515 | 12/1973 | Larios et al. . | |
| 3,939,546 | 2/1976 | Hernandez . | |
| 4,621,791 | 11/1986 | Staskiewicz et al. . | |
| 4,683,631 | 8/1987 | Dobbertin . | |
| 5,190,266 | 3/1993 | Barrera . | |
| 5,269,494 | 12/1993 | Pittman et al. . | |

*Primary Examiner*—Robert C. Watson
*Attorney, Agent, or Firm*—John D. Gugliotta

[57] ABSTRACT

A deck board pushing and clamping device is provided for pushing an unsecured board along its length into contact with a secured board which has been secured to a support joist, while simultaneously clamping the device to the support joist, thereby to clamp the unsecured board between the clamped device and the secured board, for one person ease in properly and efficiently securing the clamped board to the support joist with nails. The device uses a handle lever to operate a cam member onto which is attached a scissor-like pushing mechanism as well as a clamping mechanism. As the cam member is rotated with the handle lever, the scissor-like pushing mechanism moves a strike plate into contact with the unsecured board while the clamping mechanism is simultaneously raised into a clamping position around the support joist. A locking pin secures the device in a temporarily clamped position, thereby permitting one person to minimize a gap between the unsecured board and the secured board, and subsequently to use both hands to secure the unsecured board to the support joist with nails.

16 Claims, 5 Drawing Sheets

DECK BOARD PUSHING AND CLAMPING DEVICE

BACKGROUND OF THE INVENTION

1. Field of the Invention

The present invention relates generally to a device for installing an unsecured deck board and, more particularly, to a deck board pushing and clamping device for pushing and clamping an unsecured board against a secured board for securing of the unsecured board to a support joist with nails.

2. Description of the Related Art

As is well-known in the art, devices have been made heretofore for pushing and pulling deck boards into position for nailing. For instance, U.S. Pat. No. 5,269,494, issued in the name of Pittman et al., discloses a deck and soffit board camming or pushing device for pushing boards together. A lever is used to push a camming member against an unsecured board, and the lever must be held in position while the unsecured board is secured with nails to a support joist.

In addition, U.S. Pat. No. 5,190,266, issued in the name of Barrera, discloses a decking clamp and spacer which utilizes an articulating lever assembly for straightening and installation of deck boards, wherein an operator exerts enough pressure with one hand on a lever handle, thereby leaving a second hand free to drive a nail through the board into an adjacent joist thereby securing the board.

Moreover, U.S. Pat. No. 4,621,791, issued in the name of Staskiewicz, discloses a board straightener tool consisting of a hand lever pivotally connected to a saddle place on a joist so that the hand lever can come into contact with a board on top of the joist and by using leverage, move the board to decrease the size of a gap between the board and another board for constructing decks.

However, the related art does not address the problem of clamping an unsecured board into a releasably locked position against an adjacent secured board and against a support joist, wherein both hands of a single operator are freed while the unsecured board is secured with nails to the support joist, thereby permitting single operator installation of an unsecured board used in building decks or the like.

SUMMARY OF THE INVENTION

It is therefore an object of the present invention to provide an improved board pushing device that forces an unsecured board against a secured board and a support joist prior to clamping the unsecured board into a releasably locked position against the adjacent secured board and the support joist.

Another object of the present invention is to provide a board pushing device that uses leverage to decrease the size of the gap between boards for construction of decks.

It is a feature of the present invention to provide a lever handle which is pivotally mounted to a cam assembly and a flanged strike plate.

It is a further feature of the present invention to provide an adjustable strut for clamping the present invention to support joists having various sizes.

It is a further feature of the present invention to provide a wedge attachment for adapting the present invention to remove a secured board in a prying manner from a support joist.

Briefly described according to one embodiment of the present invention, a deck board pushing and clamping device is provided for pushing an unsecured board along its length into contact with a secured board which has been secured to a support joist, while simultaneously clamping the device to the support joist, thereby to clamp the unsecured board between the clamped device and the secured board, for one-person ease in properly and efficiently securing the clamped board to the support joist with nails. The device uses a handle lever to operatively rotate a cam member onto which is attached a scissor-like pushing mechanism as well as a clamping mechanism. As the cam member is rotated with the handle lever, the scissor-like pushing mechanism moves a strike plate into contact with the unsecured board while the clamping mechanism is simultaneously raised into a clamping position around the support joist. A locking pin secures the device in a temporarily clamped position, thereby permitting one person to minimize a gap between the unsecured board and the secured board, and subsequently to use both hands to secure the unsecured board to the support joist with nails.

In accordance with another preferred embodiment, a board pushing and clamping device is adapted to push an unsecured board into contact with a secured board which has been secured to a support joist, in order that the unsecured board is positioned for securing to the support joist, wherein the board pushing device comprises: a base having a cross member which supports a first rail and an opposing second rail, wherein a first sloped mounting bracket is centrally positioned on the first rail and a second sloped mounting bracket is centrally positioned on the second rail; and pushing and clamping means pivotally attached to the base for pushing the unsecured board into contact with the secured board while simultaneously clamping the board pushing device to the support joist, thereby to clamp the unsecured board into a fixed position against the support joist, between the base and the secured board.

An advantage of the present invention is that both hands of a single operator are freed after the unsecured board is clamped into a releasably locked position.

Another advantage of the present invention is that an unsecured board that is clamped into a releasably locked position will not move while the unsecured board is secured with nails to the support joist.

Another advantage of the present invention is that a single operator can decrease the size of the gap between decking boards properly and with minimal effort.

Another advantage of the present invention is that a single operator can use both hands to safely secure an unsecured board with nails to the support joist while the unsecured board is held immobile by the present invention to the support joist.

Another advantage of the present invention is that it assists in squaring an unsecured twisted joist against a stringer.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
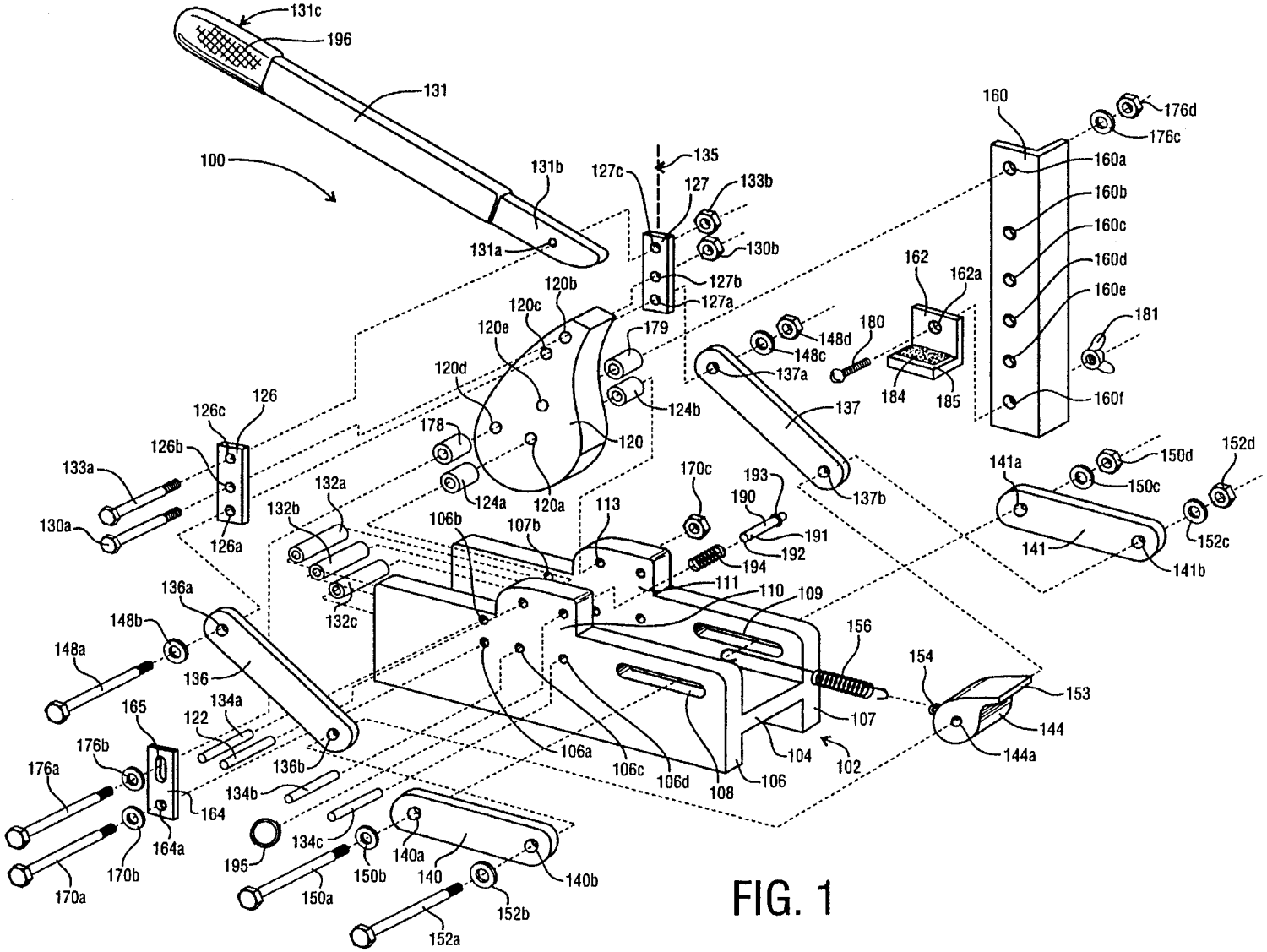
FIG. 1 is an exploded perspective view of a deck board pushing and clamping device according to a preferred embodiment of the present invention.

Referring now to FIG. 1, an exploded perspective view of a deck board pushing and clamping device 100 is shown, according to a preferred embodiment of the present invention. A base 102 has a cross member 104 which supports a first rail 106 and an opposing second rail 107. The first rail 106 has apertures 106*a*, 106*b*, 106*c*, and 106*d* and the second rail 107 has opposing apertures (not shown). Additionally, the rails 106, 107 define an elongated slot 108, 109, respectively. The rails 106, 107 are adapted to define a centrally-positioned sloped mounting bracket 110, 111, respectively. The sloped mounting bracket 110 has a cam aperture 112 and the sloped mounting bracket 111 has an opposing cam aperture 113. The mounting bracket 110 also has a locking pin aperture 114. A preferred embodiment of the base 102 is constructed of material of sufficient strength to withstand material fatigue due to stress, such as a steel or aluminum alloy material fashioned in the form of an I-beam, which is well-known in the art. A preferred embodiment of the present invention glues sandpaper (not shown) to the underside portion (not shown) of the cross member 104, thereby to provide a more secure clamping grip on a support joist 202 (see FIG. 2). Another preferred embodiment etches a gnarling (not shown), such as a crisscross pattern, for instance into the underside portion (not shown) of the cross member 104.

A cam member 120, having apertures 120*a*, 120*b*, 120*c*, 120*d*, and 120*e*, is rotatably mounted onto a cam axle 122, which is received by the cam aperture 112 in the sloped mounting bracket 110, a first spacing roller 124*a*, the aperture 120*a* in the cam member 120, a second spacing roller 124*b*, and the cam aperture 113 in the sloped mounting bracket 111.

A first handle mounting bracket 126 has apertures 126*a*, 126*b*, and 126*c*. A second handle mounting bracket 127 has apertures 127*a*, 127*b*, and 127*c*. The handle mounting brackets 126, 127 are mounted on opposing sides of the cam member 120 by threading a bolt 130*a* through the apertures 126*b*, 120*b*, 127*b*, and into a nut 130*b*.

A handle 131 has a handle aperture 131*a*. The handle 131 is rotatably mounted between the first and second handle mounting brackets 126, 127 by threading a bolt 133*a* through the aperture 126*c* of the first handle mounting bracket 126, through the handle aperture 131*a*, through the aperture 127*c* of the second handle mounting bracket, and into a nut 133*b*. The bolt 133*a* is of sufficient length to permit axial rotation of the handle 131 about the bolt 133*a* when the nut 133*b* is tightened. A first end 131*b* of the handle 131 is of sufficient length to contact the cam member 120 when the handle 131 is aligned with an axis 135 defined by the second handle mounting bracket 126. A preferred embodiment of the handle 131 etches a handle gnarling 196 at a second end 131*c* to provide for a more secure gripping surface. Another preferred embodiment of the handle has a length of 31 inches. One skilled in the art will recognize that more leverage is provided by a handle of longer length, and less leverage is provided by a handle of shorter length.

A preferred embodiment of the present invention supports the cam member 120 with a plurality of hardened rollers 132*a*, 132*b*, and 132*c*, which contact an edge of the cam member 120 and which are rotatably mounted between the rails 106 and 107 with hardened axles 134*a*, 134*b*, 134*c*, respectively. The hardened axles 134*a*, 134*b*, and 134*c* are threaded through the apertures 106*b*, 106*c*, 106*d*, respectively, in the first rail 106, and through aperture 107*b* and opposing apertures (not shown), respectively, in the second rail 107. The hardened rollers 132*a*, 132*b*, 132*c* provide support to the cam member 120 in addition to the cam axle 122. In order to eliminate protrusion of the axles away from the outside edge of the rails 106, 107, the cam axle 122, and the hardened axles 132*a*, 132*b*, and 132*c* each approximate the width of the cross member 104, which width is preferably about 2.5 inches. Further, the hardened axles 132*a*, 132*b*, and 132*c* each have a raised knurl approximating 0.25 inches to secure them in place.

A scissor-like pushing mechanism 210 (see FIG. 2) comprises first and second main members 136, 137, first and second secondary members 140, 141 and a strike plate 144. The first main member 136 has apertures 136*a* and 136*b*. The second main member has apertures 137*a* and 137*b*. The first secondary member 140 has apertures 140*a* and 140*b*. The second secondary member 141 has apertures 141*a* and 141*b*. The strike plate 144 has an aperture 144*a*.

The main members 136, 137 are rotatably mounted on opposing sides of the handle mounting brackets 126, 127 by threading a hardened bolt 148*a* through a washer 148*b*, then through the apertures 136*a*, 126*a*, 120*c*, 127*a*, 137*a*, through a washer 148*c*, and into a nut 148*d*. The bolt 148*a* is of sufficient length to permit axial rotation of the main members 136, 137 about the bolt 148*a* when the nut 148*d* is tightened.

The secondary members 140, 141 are rotatably and slidably mounted to opposing sides of the base 102 by threading a bolt 150*a* through a washer 150*b*, through the aperture 140*a* of the first secondary member 140, then through the elongated slots 108 and 109, through the aperture 141*a* of the second secondary member 141, through a washer 150*c*, and into a nut 150*d*. The bolt 150*a* is of sufficient length to permit axial rotation of the main members 136, 137 about the bolt 148*a*, and slidable movement of the bolt 150*a* through the elongated slots 108, 109 when the nut 150*d* is tightened.

The strike plate 144 is rotatably mounted between the first and second main and secondary members by threading a bolt 152*a* through a washer 152*b*, then through the aperture 140*b* of the first secondary member 140, through the aperture 136*b* of the first main member 136, through the aperture 144*a* of the strike plate 144, through the aperture 137*b* of the second main member 137, through the aperture 141*b* of the second secondary member 141, through a washer 152*c* and into a nut 152*d*. The bolt 152*a* is of sufficient length to permit axial rotation of the first and second main and secondary members and of the strike plate 144 about the bolt 152*a* when the nut 152*d* is tightened.

A preferred embodiment of the strike plate 144 has a lip 153 and a loop 154. In a preferred embodiment, the strike plate 144 is spring-adjusted by attaching a spring 156 to the loop 154 and to the bolt 152*a* between the rails 106, 107, thereby to urge the lip 153 of strike plate 144 into a position that readily adjusts over the top edge of an unsecured board 250, in order that the unsecured board 250 is held by the lip 153 when the strike plate is pressing against the unsecured board 250 (see FIG. 3). In this manner, the strike plate 144 is adjustable to accommodate a plurality of widths of unsecured boards.

A clamping mechanism 260 (see FIG. 2) comprises a lift plate 160, preferably an L-bracket approximating 1 inch by 2 inches, having a gripping member 162, and a stability plate 164. The lift plate 160 has apertures 160*a*, 160*b*, 160*c*, 160*d*, 160*e*, and 160*f*. The gripping member 162 has an aperture 162*a*. The stability plate 164 has an aperture 164*a* and an elongated slot 165.

The stability plate 164 is rotatably mounted to the first rail 106 by threading a bolt through a washer 170*b*, through the aperture 164*a* in the stability plate 164, through the aperture 106*a* in the rail 106, through the opposing aperture (not shown) in the rail 107, and into a nut 170*c*. The bolt 170*a* is of sufficient length to permit axial rotation of the stability plate 164 about the bolt 170*a* when the nut 170*c* is tightened.

The L-bracket lift plate 160 is rotatably mounted to the cam member 120 by threading a hardened bolt 176*a* through a washer 176*b*, through the elongated slot 165 of the stability plate 164, through a first lift plate roller 178, through the aperture 120*d* in the cam member 120, through a second lift plate roller 179, through the aperture 160*a*, through a washer 176*c*, and into a nut 176*d*. The bolt 176*a* is of sufficient length to permit axial rotation of the lift plate 160 about the bolt 176*a* when the nut 176*d* is tightened. The elongated slot 165 of the stability plate 164 permits rotatable and slidable movement of the bolt 176*d* therewithin.

The gripping member 162 is removably attached to the lift plate 160 by threading a bolt 180 through the aperture 162*a* of the gripping member 162, then through one of the plurality of apertures 160*b*, 160*c*, 160*d*, 160*e*, 160*f* and into a wingnut 181. The plurality of apertures 160*b*, 160*c*, 160*d*, 160*e*, 160*f* are positioned within the lift plate according to well-known sizes of support joists, thereby to permit the gripping member 162 to be adjusted to accommodate a plurality of sizes of support joists. A preferred embodiment of the gripping member 162 is L-shaped and has a sandpaper patch 184 glued to a gripping surface 185 to provide a more secure clamping grip on the support joist 202 (see FIG. 2). Another preferred embodiment etches a gnarling (not shown), such as a crisscross pattern, for instance into the gripping surface 185.

A locking pin 190 has an aperture 191 in a first end 192 and has a flanged second end 193. The locking pin 190 is tensioned with a spring 194 by threading the locking pin 190 through the spring 194 and inserting the first end 192 into the aperture 114 of the sloped mounting bracket 110. The flanged second end 193 slidingly cooperates with the surface of the cam member 120, thereby holding the pin 190 against the tension of the locking pin spring 194 when the aperture 120*e* is out of alignment with the locking pin 190. A pull ring 195 threaded through the aperture 191 permits the locking pin 190 to be pulled, through the aperture 114, against the tension of the locking pin spring 194 and away from the cam member 120.

Figure 2:
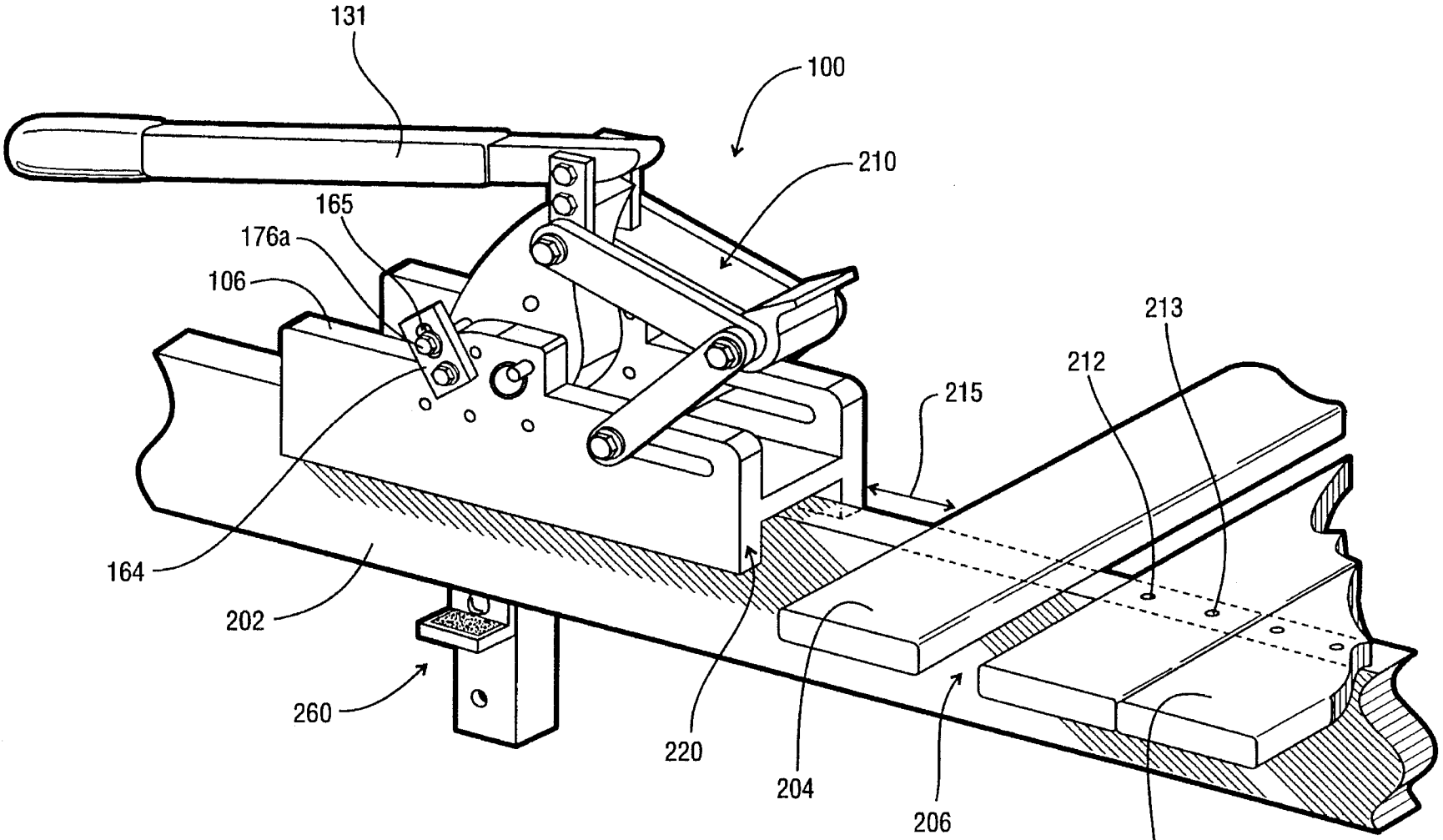
FIG. 2 is a perspective view of the deck board pushing and clamping device in an open position atop a support joist prior to pushing an unsecured board into contact with a secured decking board.

Referring to FIG. 2, a perspective view shows the deck board pushing and clamping device 100 in an open position atop the support joist 202. The handle 131 is rotatably mounted, thereby to permit positioning of the handle away from the unsecured board 204, as shown. A gap 206, preferably approximating 0.25 inches, is shown between the unsecured board 204 and the secured board 208, which is secured to the support joist 202 with nails 212 and 213. A distance 215, preferably approximating one inch, is shown between a front edge 220 of the base 102 and the unsecured board 204. The scissor-like pushing mechanism 210 is shown an open position, ready for operation. The clamping mechanism 260 is shown in an unclamped position, with the bolt 170a within the elongated slot 165 of the stability plate 164 shown positioned on the rail 106, ready for operation.

Figure 3:
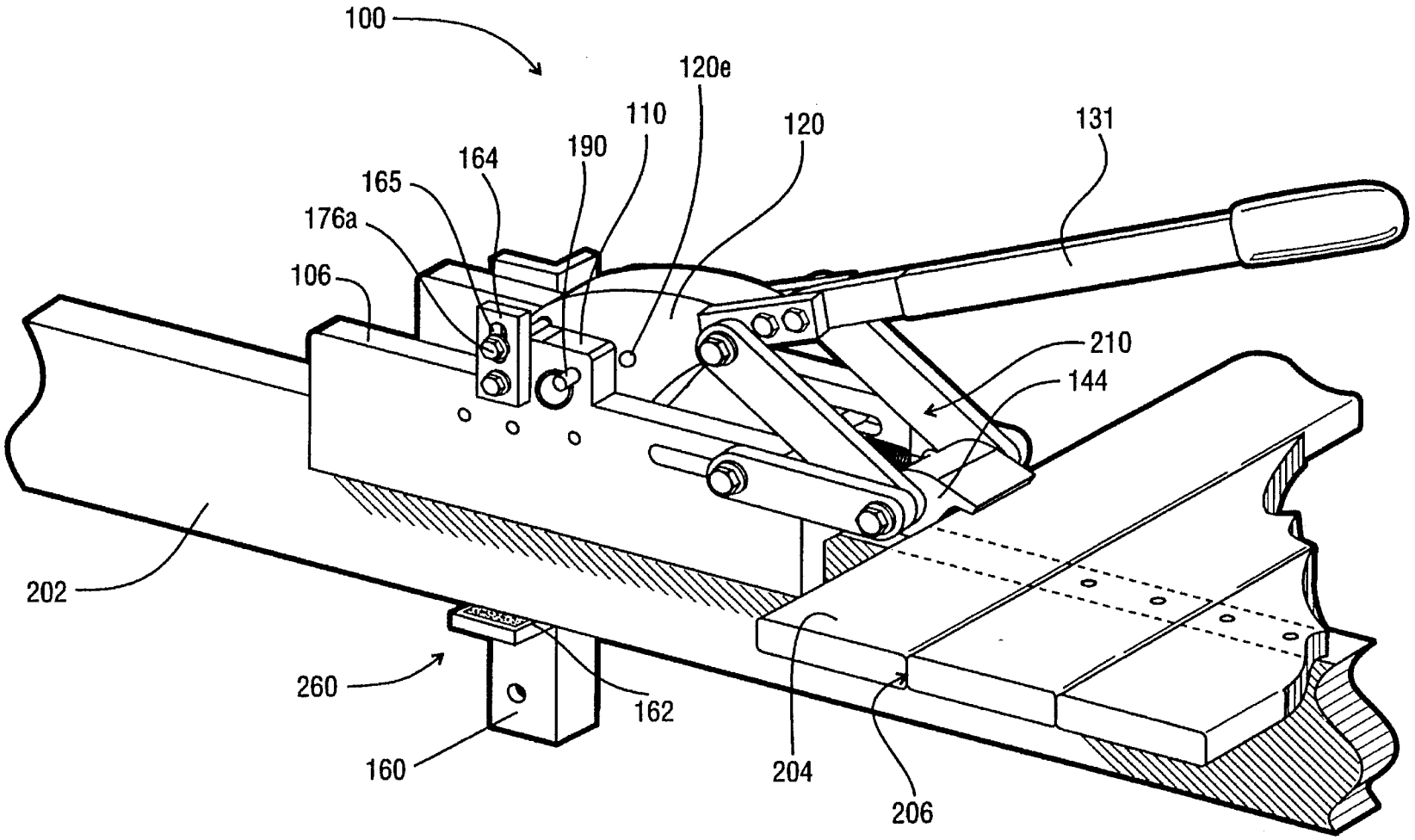
FIG. 3 is a perspective view of the deck board pushing and clamping device in a partially closed position just prior to clamping onto the support joist and locking into a closed position.

FIG. 3 is a perspective view of the deck board pushing and clamping device in a partially closed position. The clamping mechanism is partially clamped, with the bolt 170*a* within the elongated slot 165 of the stablity plate 164 shown positioned atop the sloped mounting bracket 110 of the rail 106, and with the gripping member 162 shown raised toward the support joist 202 by the lift plate 160, which has been raised when the bolt 170*a* was moved atop the sloped mounting bracket 110 by the axial rotation of the cam member 120 toward the unsecured board 204.

The scissor-like pushing mechanism 210 is shown in a partially closed position, with the strike plate 144 pressed against the unsecured board 204, thereby to decrease the gap 206, as compared to FIG. 2. The device 100 will lock into a fully clamped position when the cam member 120 is further moved toward the unsecured board 204 with the handle 131, thereby to align the aperture 120e with the locking pin 190, which is tensioned by the locking pin spring 194 (see FIG. 1), in order to snap the locking pin 190 into the aperture 120*e*.

Figure 4:
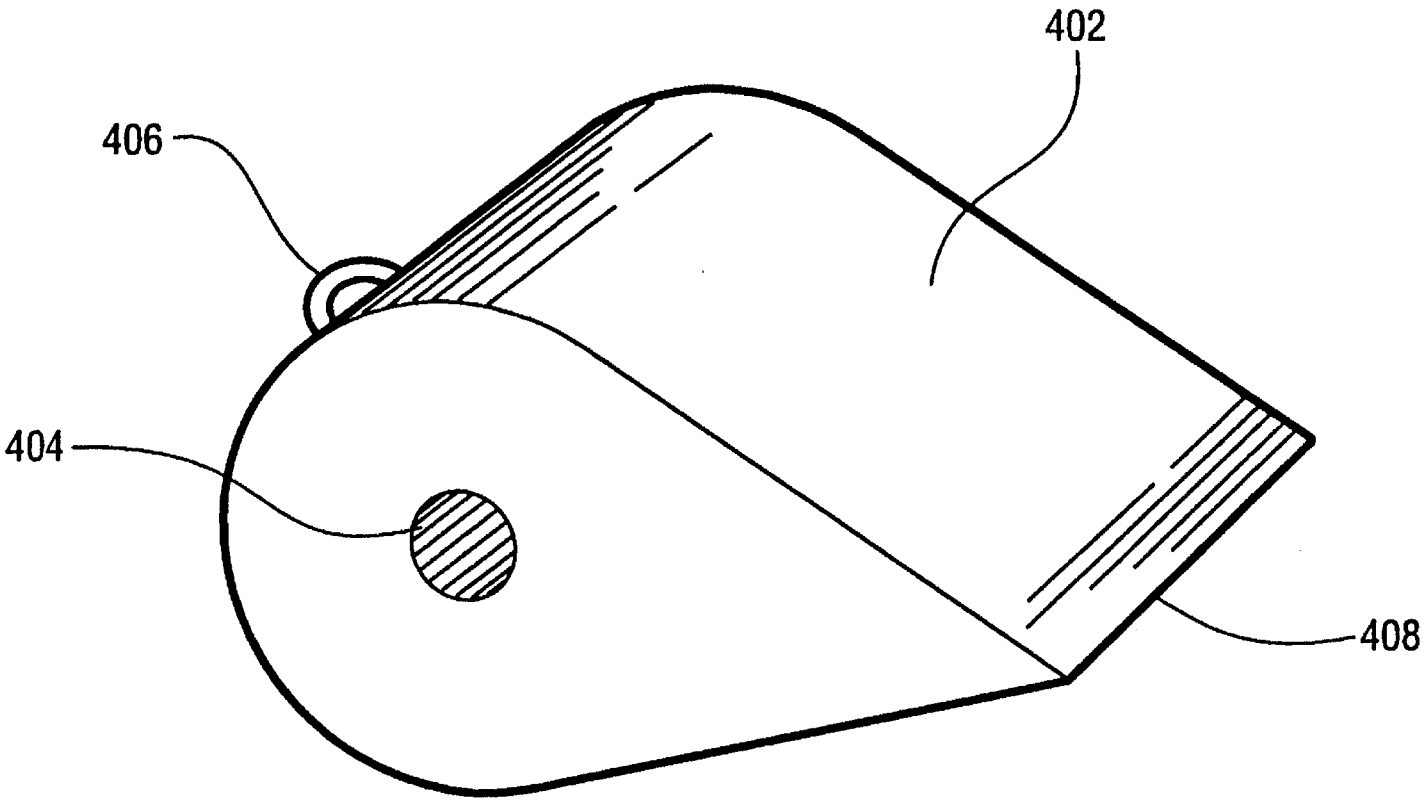
FIG. 4 is a perspective view of a hardened wedge attachment accessory for the present invention.

FIG. 4 is a perspective view of a hardened wedge attachment accessory 402 for the present invention. The wedge attachment accessory 402 has a wedge aperture 404, a wedge loop 406 for attaching the spring 156, and a pry edge 408.

Figure 5:
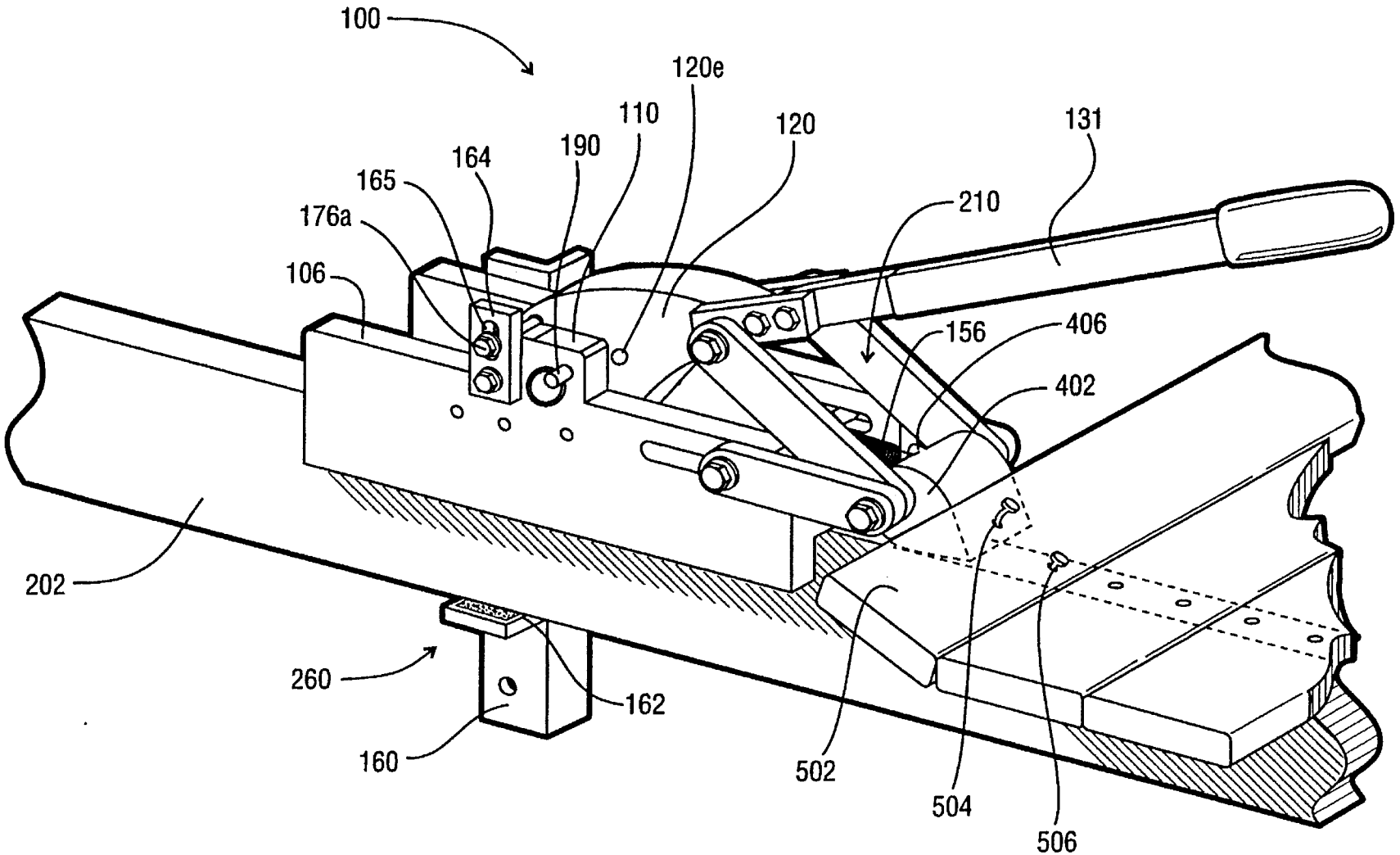
FIG. 5 is a perspective view of the present invention showing the use of the hardened wedge attachment accessory of FIG. 4 for prying a secured board from a support joist.

FIG. 5 is a perspective view of the present invention showing the use of the hardened wedge attachment accessory 402 of FIG. 4 for prying a secured board from the support joist 202. The strike plate 144 shown in FIGS. 2 and 3 has been removed from the present invention and replaced by the wedge attachment accessory 402 in a manner well-known in the art, with the spring 156 attached to the wedge loop 406. The present invention is shown in the partially closed position shown in FIG. 3. Specifically, the clamping mechanism is partially clamped, and the scissor-like pushing mechanism 210 is shown in a partially closed position, as shown in FIG. 3 when compared to FIG. 2. However, FIG. 5 shows the wedge attachment accessory 402 forced partially between the support joist 202 and a secured board 502, which has been secured with nails 504 and 506, thereby prying the secured board 502 away from the support joist 202. Similarly to FIG. 3, the device 100 will lock into a fully clamped position when the cam member 120 is further moved toward the unsecured board 204 with the handle 131, thereby to align the aperture 120e with the locking pin 190, which is tensioned by the spring 192 (see FIG. 1), in order to snap the locking pin 190 into the aperture 120*e*.

2. Operation of the Preferred Embodiment

In operation, the present invention is held by the handle 131 and placed in a resting position on the support joist 202, in order that the cross member 104 of the base 102 rests on a narrow edge of the support joist 202, with the lift plate 160 hanging adjacent the support joist and the gripping member 162 extending below the support joist a predetermined distance, preferably approximately 0.75 inch from the bottom edge of the support joist. The front edge 220 of the base 102 rests a predetermined distance, preferably approximately 1 inch, from the unsecured board desired to be secured. The gap 206 between the unsecured board and the secured board preferably approximates about 0.25 inches.

From this resting position, the handle 131 is pulled with a downward force toward the unsecured board 204, thereby rotating the cam member 120 in the same direction. As the cam member 120 is rotated, the scissor-like pushing mechanism 202, which is attached to the cam member 120, moves the strike plate 144 downwardly toward the unsecured board 204 as the clamping mechanism 260, which is also attached the cam member 120, simultaneously moves the first and second lift plate rollers 178 and 179 up the sloped mounting bracket 110 and 111, respectively, thereby to raise the L-bracket lift plate 160, which raises the attached L-bracket gripping member 162 toward the support joist into a clamping position, thereby to clamp the support joist 202 between the gripping surface 185 of the gripping member 162 and the cross member 104 of the base 102. The strike plate 144 adjusts against the unsecured board just as and the gripping member 162 adjusts to clamp against the support joist 202.

As the handle 131 is pulled downward, the present invention pushes the unsecured board 204 into contact with the secured board 208 as the L-bracket gripping member 162 is tightened by the L-bracket lift plate 160 against the support joist 202, thereby to securely clamp the present invention to the support joist 202 as the unsecured board 204 is held into contact with the secured board 208 by the strike plate 144.

The present invention locks into the clamped position when the handle is forced sufficiently downward to align the aperture **120*e* with the spring-tensioned locking pin 190, which then snaps into the aperture 120*e***, thereby to lock the present invention into the clamped position.

In the locked clamped position, the unsecured board 204 is securely clamped between the strike plate 144 and the secured board 208, as well as against the support joist 202. The handle 131, which is pivotally attached to the handle mounting brackets 126 and 127, may be pivoted away from the clamped unsecured board 204 in order to provide an unobstructed area above the clamped unsecured board 204 in which to secure, preferably with a plurality of nails, the clamped unsecured board 204 to the support joist 202.

To unlock the present invention from the clamped position, simply press downwardly slightly on the handle 131 in order to remove lateral tension on the locking pin 190, and then remove the locking pin 190 from the aperture **120*e* by pulling outwardly on the locking pin pull ring 195, thereby permitting the cam member 120 to pivot upwardly away from the support joist 202. The upward pivotal movement of the cam 120 moves the strike plate 144 away from the unsecured board 204 while at the same time moves the gripping member 162 downwardly away from the support joist 202**.

When the wedge attachment accessory 402 is utilized in place of the strike plate 144, the wedge attachment accessory 402 is positioned with the pry edge 408 directed between the secured board 502 and the support joist 202, in order to be forced between the secured board 502 and the support joist 202 by the scissor-like pushing mechanism 210 as and the gripping member 162 adjusts to clamp against the support joist 202, thereby prying the secured board 502 away from the support joist 202 with the wedge attachment 402.

The present invention is adjustable to clamp onto various sized support joists, such as 2×4, 2×6, 2×8, 2×10, and 2×12, for instance, by removing the wingnut 181 in order to place the bolt 180 for the gripping member 162 into an appropriate aperture, such as one of the apertures **160*b*, 160*c*, 160*d*, 160*e*, 160*f*, for instance, and then replacing the wingnut 181 onto the bolt 180**.

The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A deck board pushing and clamping device for pushing an unsecured board along its length into contact with a secured board which has been secured to a support joist, while simultaneously clamping the device to the support joist, thereby to clamp the unsecured board between the clamped device and the secured board, in order that said unsecured board is positioned for securing to said support joist, wherein the deck board pushing and clamping device comprises:

a base having a cross member which supports a first rail and an opposing second rail, wherein a first sloped mounting bracket is centrally positioned on said first rail and a second sloped mounting bracket is centrally positioned on said second rail;

a cam assembly pivotally attached to said base;

an operating lever pivotally attached to said cam assembly;

a clamping mechanism pivotally attached to said cam assembly whereby, in operation, said deck board pushing and clamping device is positioned adjacent said unsecured board and adjacent said support joist, with said support joist between said first and second rail and covered by said cross member, such that pivoting said cam assembly with said lever toward said unsecured board pushes said unsecured board into contact with said secured board while said clamping mechanism slides upwardly along said first and second sloped mounting bracket, thereby clamping in a clamped position said deck board pushing and clamping device to said support joist, in order to clamp said unsecured board into a fixed position against said support joist, between said base and said secured board.

2. The board pushing and clamping device according to claim 1, wherein said board pushing device further comprises:

locking means for locking said device in said clamped position.

3. The board pushing and clamping device according to claim 2, wherein said locking means is a locking pin which is slidably mounted within said first sloped mounting bracket.

4. The board pushing and clamping device according to claim 3, wherein said locking pin is spring tensioned to force a first end into a locking aperture in said cam assembly when said locking aperture is aligned with said locking pin.

5. The board pushing and clamping device according to claim 2, wherein said lever handle pivots away from said unsecured board when said device is locked in said clamped position.

6. A board pushing and clamping device adapted to push an unsecured board into contact with a secured board which has been secured to a support joist, in order that said unsecured board is positioned for securing to said support joist, wherein the board pushing device comprises:

a base having a cross member which supports a first rail and an opposing second rail, wherein a first sloped mounting bracket is centrally positioned on said first rail and a second sloped mounting bracket is centrally positioned on said second rail; and pushing and clamping means pivotally attached to said base for pushing said unsecured board into contact with said secured board while simultaneously clamping in a clamped position said board pushing device to said support joist, thereby to clamp said unsecured board into a fixed position against said support joist, between said base and said secured board, wherein said pushing and clamping means further comprises:

a cam member pivotally attached to said base;

an operating lever pivotally attached to said cam member;

a scissor-like pushing member having a first end, a second end, and a jointed end, wherein said first end is pivotally attached to said cam member and said second end is pivotally attached to said base, wherein said second end is slidable within said base;

a strike plate attached to said jointed end; and a clamping mechanism having a clamping axle and a clamping plate, wherein said clamping mechanism is pivotally attached to said cam member whereby pivotal movement of said cam member toward said unsecured board pushes said strike plate toward said unsecured board while simultaneously moves said clamping axle upwardly along said first and second sloped mounting bracket, thereby to press said support joist between said cross member of said base and said clamping plate.

7. The board pushing and clamping device according to claim 6 further comprising:

a wedge, wherein said wedge is used in place of said strike plate in said jointed end, in order that pivotal movement of said cam member toward a secured board in said support joist pushes said wedge between said secured board and said support joist while simultaneously moves said clamping axle upwardly along said first and second sloped mounting bracket, thereby to pry said secured board from said support joist.

8. The board pushing and clamping device according to claim 7, wherein said board pushing device further comprises:

locking means for locking said device in said clamped position.

9. The board pushing and clamping device according to claim 8, wherein said locking means is a locking pin which is slidably mounted within said first sloped mounting bracket.

10. The board pushing and clamping device according to claim 9, wherein said locking pin is spring tensioned to force a first end into a locking aperture in said cam assembly when said locking aperture is aligned with said locking pin.

11. The board pushing and clamping device according to claim 8, wherein said lever handle pivots away from said unsecured board when said device is locked in said clamped position.

12. A board pushing and clamping device adapted to pry a secured board from a support joist to which the secured board has been secured, wherein the board pushing device comprises:

a base having a cross member which supports a first rail and an opposing second rail, wherein a first sloped mounting bracket is centrally positioned on said first rail and a second sloped mounting bracket is centrally positioned on said second rail;

a cam member pivotally attached to said base;

an operating lever pivotally attached to said cam member;

a scissor-like pushing member having a first end, a second end, and a jointed end, wherein said first end is pivotally attached to said cam member and said second end is pivotally attached to said base, wherein said second end is slidable within said base;

a wedge attached to said jointed end; and a clamping mechanism having a clamping axle and a clamping plate, wherein said clamping mechanism is pivotally attached to said cam member whereby pivotal movement of said cam member toward said secured board pushes said wedge between said secured board and said support joist while simultaneously moves said clamping axle upwardly along said first and second sloped mounting bracket into a clamping position, thereby to pry said secured board from said support joist.

13. The board pushing and clamping device according to claim 12, wherein said board pushing device further comprises:

locking means for locking said device in said clamping position.

14. The board pushing and clamping device according to claim 13, wherein said locking means is a locking pin which is slidably mounted within said first sloped mounting bracket.

15. The board pushing and clamping device according to claim 14, wherein said locking pin is spring tensioned to force a first end into a locking aperture in said cam assembly when said locking aperture is aligned with said locking pin.

16. The board pushing and clamping device according to claim 13, wherein said lever handle pivots away from said unsecured board when said device is locked in said clamping position.

* * * * *